US005422209A

United States Patent [19]

Ono et al.

[11] Patent Number: 5,422,209

[45] Date of Patent: Jun. 6, 1995

[54] ELECTROPHOTOGRAPHIC PHOTORECEPTOR HAVING A PHOTOCONDUCTIVE LAYER OF AMORPHOUS SILICON AND SURFACE LAYER

[75] Inventors: Masato Ono; Taketoshi Higashi; Masao Watanabe; Masaki Yokoi; Yuzuru Fukuda; Shigeru Yagi, all of Minami Ashigara, Japan

[73] Assignee: Fuji Xerox Co., Ltd., Tokyo, Japan

[21] Appl. No.: 254,420

[22] Filed: Jun. 6, 1994

Related U.S. Application Data

[63] Continuation of Ser. No. 862,369, Apr. 2, 1992, abandoned.

[30] Foreign Application Priority Data

Apr. 12, 1991 [JP] Japan ..... 3-106488

[51] Int. Cl.[6] ..... G03G 5/14

[52] U.S. Cl. ..... 430/57; 430/66; 430/84

[58] Field of Search ..... 430/58, 57, 84, 66

[56] References Cited

U.S. PATENT DOCUMENTS 4,810,606 3/1989 Iino et al. ..... 430/84
4,988,597 1/1991 Spiewak et al. ..... 430/64
5,100,749 3/1992 Narikawa et al. ..... 430/84

FOREIGN PATENT DOCUMENTS 56-62254 5/1981 Japan .
56-62255 5/1981 Japan .
61-29851 2/1986 Japan .

*Primary Examiner*—John Goodrow
*Attorney, Agent, or Firm*—Oliff & Berridge

[57] ABSTRACT

An electrophotographic photoreceptor is disclosed, comprising an electrically conductive substrate having provided thereon at least a photoconductive layer and a surface layer, wherein the photoconductive layer comprises (a) a charge transporting layer mainly composed of amorphous silicon containing at least one of hydrogen and a halogen and at least one selected from carbon, oxygen, and nitrogen and (b) a charge generating layer composed of amorphous silicon containing at least one of hydrogen and a halogen or amorphous silicon containing at least one of hydrogen and a halogen and at least one selected from germanium and tin, and the surface layer is composed of at least one of an organic polymer material and an inorganic polymer material having dispersed therein an electrically conductive fine powder. The photoreceptor shows less dark decay of the charged potential, does not cause image blurring under a high-humidity condition, and forms an image having no moire in a laser printer using a coherent light source.

9 Claims, 1 Drawing Sheet

ELECTROPHOTOGRAPHIC PHOTORECEPTOR HAVING A PHOTOCONDUCTIVE LAYER OF AMORPHOUS SILICON AND SURFACE LAYER

This is a continuation of application Ser. No. 07/862,369 filed Apr. 2, 1992, now abandoned.

FIELD OF THE INVENTION

The present invention relates to an electrophotographic photoreceptor, and more particularly to an electrophotographic photoreceptor using amorphous silicon for the photoconductive layer.

BACKGROUND OF THE INVENTION

An electrophotographic process is a process of obtaining a duplicate or copy by electrostatically charging an electrophotographic photoreceptor, image-exposing the photoreceptor to form electrostatic latent image, developing the latent image with a developer (toner), transferring the toner image formed on the photoreceptor onto a transfer paper, and fixing the transferred toner image.

The electrophotographic photoreceptor being used in the electrophotographic process is composed of an electrically conductive substrate having formed thereon a photo-sensitive layer as the fundamental structure, as the materials constituting the photosensitive layer, amorphous silicon (hydrogenated amorphous silicon) is known, and recently various improvements have been attempted.

The electrophotographic photoreceptor using the amorphous silicon (hereinafter, is referred to as amorphous silicon photoreceptor) is produced by forming an amorphous layer of silicon on an electrically conductive substrate by a glow discharging decomposition method of a silane ($SiH_4$) gas and hydrogen atoms are contained in the amorphous silicon layer to show a good photoconductivity. The amorphous silicon photoreceptor has features that the surface hardness of the photosensitive layer thereof is high, the photoreceptor is excellent in abrasion resistance, has a high heat resistance, is excellent in electrical stability, has a wide spectral sensitivity, and has a high light sensitivity, and is an electrophotographic photoreceptor having an ideal property as an electrophotographic photoreceptor.

The amorphous silicon photoreceptor has the excellent characteristics as photoreceptor as described above but the dark resistance thereof is relatively low and hence has the disadvantage that the dark decay of the photoconductive layer is large and when the photoreceptor is charged, a sufficient charged potential is not obtained. In other words, the amorphous silicon photoreceptor has the disadvantage that in the case of charging the photoreceptor, image-exposing the photoreceptor to form an electrostatic latent image, and then developing the latent image, the surface potential on the photoreceptor is decayed before the image-exposure or the charges at the unexposed portions are decayed before the development step, whereby the charged potential necessary for development is hard to obtain.

The decay of the charged potential is liable to be changed by the influence of the surrounding conditions, and in particular, under a high-temperature high-humidity circumstance, the charged potential is greatly lowered. Furthermore, when the photoreceptor is repeatedly used, the charged potential is gradually lowered.

When a copy is made by using the electrophotographic photoreceptor showing such a large dark decay of the charged potential, the copy obtained has a low image density and a poor reproducibility of half tone.

For improving the aforesaid point, it has been proposed to form amorphous silicon as a photoconductive layer and applying amorphous silicon carbide, amorphous silicon nitride, or amorphous silicon oxide onto the photoconductive layer by a plasma CVD method to form a charge blocking layer which further functions, at the same time, as a surface protective layer.

However, in the amorphous silicon photoreceptor having the surface protective layer formed as described above, there is a problem that by repeating the copying operation, an image blurring occurs. This phenomenon is particularly severe at a high-humidity circumstance and hence such an amorphous silicon photoreceptor cannot be used for an ordinary electrophotographic process.

Also, a process of increasing the dark resistance and, at the same time, reducing the dielectric constant by doping carbon, nitrogen, oxygen, etc., into the amorphous silicon layer has been proposed as described in JP-A-56-62254 and JP-A-56-62255. (The term "JP-A" as used herein means an "unexamined published Japanese patent application"). However, in the foregoing process, an optical gap is broadened, whereby the sensitivity in a long wavelength region is lost and thus the process cannot be used for a printer using a semiconductor laser.

Furthermore, a process of preventing the occurrence of interference fringes by most suitably selecting the reflective index and the thickness of the surface layer composed of amorphous silicon carbide, amorphous silicon nitride, etc., has been proposed as described in JP-A-61-29851. However, in the foregoing process, the surface layer is abraded by repeating the copying operation for a long period of time, whereby the surface layer loses the function of preventing the reflection of light. Also, the process cannot cope with the gap of the oscillation wavelength of a semiconductor laser by the change of the surrounding conditions.

Still further, amorphous silicon formed by a plasma CVD method has a high surface hardness but has a fault that the amorphous silicon is liable to be cracked and is weak to shock as compared to a selenium-series photosensitive layer and an organic photoreceptor. Accordingly, the amorphous silicon photoreceptor is scratched by a paper-releasing claw, etc., in a copying apparatus or a printer, which results in causing a problem that white points and black points are liable to form on the image of the copy.

Also, an amorphous silicon photoreceptor has many semispherical defects having a diameter of from 1 $\mu$m to 30 $\mu$m at the surface of the photosensitive layer and by repeating a copying operation, electrical or mechanical destructions occur at the defect portions of the layer to form white points and black points on the images formed, which reduces the quality of images.

SUMMARY OF THE INVENTION

The present invention has been made for overcoming these faults in such an amorphous silicon photoreceptor.

That is, an object of the present invention is to provide an amorphous silicon photoreceptor showing less dark decay of the charged electrostatic potential.

Other objects of the present invention is to provide an amorphous silicon photoreceptor which does not cause image blurring under a high-humidity condition and can be applied to an ordinary electrophotographic process.

Still other object of the present invention is to provide an electrophotographic photoreceptor which can form image having no moire in a laser printer using a coherent light source.

As the result of various investigations, the inventors have obtained the knowledge that an amorphous film mainly composed of silicon, nitrogen, and carbon formed by a plasma CVD method is thermally and mechanically stable when the film exists as a surface layer; although the film is photoelectrically stable in an electrophotographic process, the film is unstable in the point of the surface oxidation as compared to other substances; and the oxidized film formed on the surface thereof is more active than an organic polymer film and an inorganic polymer film in regard to the adsorption of moisture and corotron products. Also, the inventors have discovered that the destruction of film defect portions, which is considered to -determine the life of the amorphous silicon photoreceptor can be prevented by dispersing the ion stream from a corotron without concentrating it to the film defect portions.

The present invention has been accomplished based on this knowledge.

That is, according to the present invention, there is provided an electrophotographic photoreceptor comprising at least an electrically conductive substrate having formed thereon a photoconductive layer and a surface layer, wherein said photoconductive layer comprises at least a charge transporting layer mainly composed of amorphous silicon containing hydrogen and/or a halogen and at least one selected from carbon, oxygen, and nitrogen and a charge generating layer composed of amorphous silicon containing hydrogen and/or a halogen or amorphous silicon containing hydrogen and/or a halogen and at least one selected from germanium and tin, and said surface layer comprises an organic polymer material and/or an inorganic polymer material having dispersed therein electrically conductive fine particles.

In the electrophotographic photoreceptor of the present invention, it is preferred to provide at least one layer mainly composed of amorphous silicon carbide, amorphous silicon nitride, amorphous silicon oxide, or amorphous carbon each containing at least one of hydrogen and a halogen between the surface layer and the photoconductive layer as an interlayer.

Further, in the electrophotographic photoreceptor of the present invention, it is preferred that the charge generating layer or the charge transporting layer contains an element belonging to group III or group V of the periodic Table. Furthermore, it is also preferred to provide a charge blocking layer between the photoconductive layer and the electrically conductive substrate of the photoreceptor of the present invention.

DETAILED DESCRIPTION OF THE INVENTION

Then, the present invention is described in detail.

Figure 1:
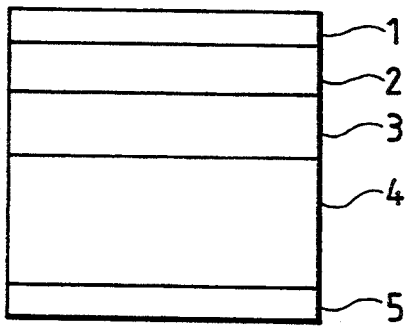
FIG. 1 is a schematic cross-sectional view showing the layer structure of an example of the electrophotographic photoreceptor of the present invention.

The electrophotographic photoreceptor has, in an example thereof, the layer structure shown in FIG. 1.

As shown in FIG. 1, the electrophotographic photoreceptor is composed of a surface layer 1 composed of an organic polymer material and/or an inorganic polymer material having dispersed therein electrically conductive fine particles, an intermediate layer 2, a charge generating layer 3 composed of amorphous silicon containing hydrogen and/or a halogen or amorphous silicon containing hydrogen and/or a halogen and at least one of germanium and tin, a charge transporting layer 4 mainly composed of amorphous silicon containing hydrogen and/or a halogen and at least one selected from carbon, oxygen, and nitrogen, and an electrically conductive substrate 5.

Figure 2:
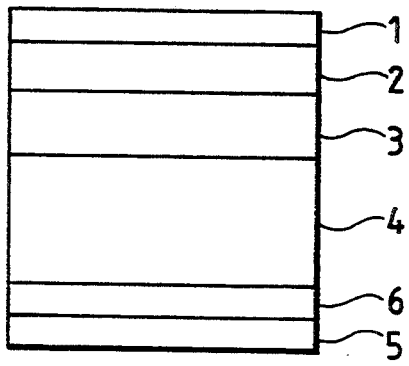
FIG. 2 is a schematic cross-sectional view showing the layer structure of other example of the electrophotographic photoreceptor of the present invention.

Also, FIG. 2 shows the layer structure of other example of the electrophotographic photoreceptor of the present invention, wherein a charge blocking layer 6 is formed between a charge transporting layer 4 constituting the photoconductive layer and an electrically conductive substrate 5.

In the present invention, as the electrically conductive substrate, either an electrically conductive support or an insulating support can be used.

As an electrically conductive support, a substrate composed of a metal such as aluminum, stainless steel, nickel, chromium, etc.; an alloy of these metals; or an intermetallic compound such as $In_2O_3$, $SnO_2$, CuI, $CrO_2$, etc., can be used.

As an insulating support, a film or sheet of a polymer such as polyester, polyethylene, polycarbonate, polystyrene, polyamide, polyimide, etc., and also glass, ceramics, etc., can be used. In the case of using the insulating support, it is necessary to apply an electrically conductivity imparting treatment (electrically conductive treatment) to at least a surface thereof being brought into contact with other layer such as a photoconductive layer. The electrically conductive treatment can be practiced by attaching the metal described above or gold, silver, copper, etc., onto the surface thereof by a vapor-deposition method, a sputtering method, an ion plating method, etc.

The electrophotographic photoreceptor of the present invention may be irradiated with electromagnetic waves from the substrate side or from the opposite side to the substrate side. In the case of irradiating the photoreceptor from the substrate side, the electrically conductive substrate must be permeable for at least the irradiating electromagnetic waves. For example, in the case of forming a metal layer by applying thereto an electrically conductive treatment, the thickness of the metal layer may be that the electromagnetic waves can permeate therethrough. Also, a transparent electrically conductive layer of ITO, etc., can be used.

Also, the form of the electrically conductive substrate may be an optional form; such as a cylindrical form, an endless belt form, etc.

In the electrophotographic photoreceptor of the present invention, if necessary, a charge blocking layer may be formed between the photoconductive layer and the electrically conductive substrate as shown in FIG. 2.

For the charge blocking layer, an insulating thin film of p-type amorphous silicon heavy-doped with an element belonging to group III of the periodic table, n-type amorphous silicon heavy-doped with an element belonging to group V of the periodic table, or $SiN_x$ ($0.3 \leqq x \leqq 1.3$), $SiO_x$ ($0.5 \leqq x \leqq 2.0$), $SiC_x$ ($0.1 \leqq x \leqq 10$), etc., can be used. The insulating thin film can be formed by the same manner as the case of forming the intermediate layer as will be described later. The thickness of the insulating layer is preferably in the range of from 0.03 μm to 10 μm.

In the present invention, the photoconductive layer is composed of a charge generating layer and a charge transporting layer each mainly composed of amorphous silicon and these layers can be formed on the electrically conductive substrate by a glow discharging method, a sputtering method, an ion plating method, a vacuum vapor-deposition method, etc. In these methods, according to a method (glow discharging method) of glow discharge-decomposing a silane ($SiH_4$) gas by a plasma CVD method, a photoconductive layer automatically containing a proper amount of hydrogen in the layer and having the optimum characteristics for electrophotographic photoreceptor, such as a relatively high dark resistance and a high light sensitivity can be formed. In this case, for more efficiently incorporating hydrogen in the photoconductive layer, a hydrogen ($H_2$) gas may be introduced into the plasma CVD apparatus simultaneously with the introduction of the silane gas.

In the present invention, as a raw material gas for forming the charge generating layer and the charge transporting layer each mainly composed of amorphous silicon, in addition to silane, a silicon hydroxide compound and a silicon halide compound, such as $Si_2H_6$, $Si_3H_6$, $Si_4H_{10}$, $SiCl_4$, $SiF_4$, $SiHF_2$, $SiH_2F_2$, $SiH_3F$, etc., can be used.

In the present invention, it is necessary to incorporate at least one of a carbon atom, an oxygen atom, and a nitrogen atom in the amorphous silicon layer of the charge transporting layer for increasing the dark resistance of the layer, increasing the light sensitivity of the layer, or increasing the charging faculty (the charging power or the charged potential per unit thickness of the layer) of the layer.

As a raw material in the case of adding a carbon atom, there are, for example, paraffinic hydrocarbons such as methane, ethane, propane, n-butane, etc.; olefinic hydrocarbons such as ethylene, propylene, butene-1, butene-2, isobutylene, etc.; acetylenic hydrocarbons such as acetylene, methylacetylene, etc.; alicyclic hydrocarbons such as cyclopropane, cyclobutane, cyclopentane, cyclohexane, cyclobutene, etc.; and aromatic hydrocarbons such as benzene, toluene, xylene, naphthalene, anthracene, etc. These hydrocarbons may be halogen-substituted hydrocarbons such as, for example, carbon tetrachloride, chloroform, carbon tetrafluoride, trifluoromethane, chlorotrifluoromethane, dichlorofluoromethane, bromotrifluoromethane, fluoroethane, and perfluoropropane.

As a raw material in the case of adding a nitrogen atom, there are gaseous or gasifiable nitrogen compounds such as nitrogen ($N_2$), ammonia ($NH_3$), hydrazine ($H_2NNH_2$), hydrogen azide ($NH_3$), etc.

As a raw material in the case of adding an oxygen atom, there are, for example, gases such as oxygen ($O_2$), ozone ($O_3$), carbon monoxide (CO), carbon dioxide ($CO_2$), nitrogen monoxide (NO), nitrogen dioxide ($NO_2$), nitrogen sesquioxide ($N_2O_3$), dinitrogen tetraoxide ($N_2O_4$), dinitrogen pentoxide ($N_2O_5$), nitrogen trioxide ($NO_3$), tetramethoxysilane [$Si(OCH_3)_4$], tetraethoxysilane [$Si(OC_2H_5)_4$], etc.

The foregoing raw materials may be in a gaseous state, a solid state, or a liquid state at normal temperature and when the raw material is in a solid state or a liquid state, the raw material is gasified at use.

In the present invention, the charge transporting layer may further contain other element(s) than those described above. For the purpose of controlling the dark resistance of the charge transporting layer or controlling the charging polarity, an element belonging to group III of the periodic table or an element belonging to group V, e.g., an impurity element such as boron (B) or a phosphorus (P) can be added (doped) to the charge transporting layer. As a raw material for adding an element belonging to group III or an element belonging to group V, there are $B_2H_6$, $B_4H_{10}$, $BF_3$, $BCl_3$, $PH_3$, $P_2H_4$, $PF_3$, $PCl_3$, etc.

The formation condition of the charge transporting layer by a plasma CVD method in the case of, e.g., alternating current discharging is as follows. That is, the frequency is usually from 0.1 to 30 MHz, and preferably from 5 to 20 MHz, the degree of vacuum at discharging is from 0.1 to 5 Torrs (1.33 to 66.7 $N/m^2$), the substrate heating temperature is from 100° C. to 400° C., and the growth rate is from 1 to 10 μm/hr.

The thickness of the charge transporting layer is in the range of from 5 μm to 100 μm, and preferably from 10 μm to 60 μm.

The charge generating layer is mainly composed of amorphous silicon containing hydrogen and/or a halogen but may contain germanium (Ge) and/or tin (Sn) for the purpose of increasing the sensitivity in a long wavelength region.

As a raw material for adding Ge, there are $GeH_4$, $Ge_2H_6$, $Ge_3H_8$, $Ge_4H_{10}$, $Ge_5H_{12}$, $GeF_4$, $GeCl_4$, etc. Also, as a raw material for adding Sn, there are $SnCl_2$, $SnCl_4$, etc.

Furthermore, for efficiently injecting a carrier into the charge generating layer, an element belonging to group III of the periodic table or an element belonging to group V can be added thereto. As a raw material gas for adding an element belonging to group III or group V, there are $B_2H_6$, $B_4H_{10}$, $BF_3$, $BC_3$, $PH_3$, $P_2H_4$, $PF_3$, $PCl_3$, etc.

The effective discharging condition in the case of forming the charge generating layer by glow discharge-decomposing a silane gas ($SiH_4$), etc., by the plasma CVD method, that is, the formation condition for an effective amorphous silicon layer or an effective amorphous silicon layer containing germanium and/or tin in the case of, e.g., alternating current discharging is as follows. That is, the frequency is usually from 0.1 to 30 MHz, and preferably from 5 to 20 MHz, the degree of vacuum at discharging is from 0.1 to 5 Torrs (1.33 to 66.7 $N/m^2$), the substrate heating temperature is from 100° C. to 400° C., and the growth rate is from 1 to 5 μm/hr.

The thickness of the charge generating layer mainly composed of amorphous silicon or amorphous silicon containing germanium and/or tin can be optionally selected but is usually from 0.5 μm to 10 μm, and preferably from 1 μm to 5 μm.

In the electrophotographic photoreceptor of the present invention, the surface layer functions as a charge blocking layer for inhibiting the injection of the charge from the surface portion of the photoconductive layer into the inside thereof at the charging treatment of the surface layer as well as functions as a surface protective layer for inhibiting the direct contact or the adsorption of oxidizing molecules generally existing in the surrounding atmosphere, such as oxygen, steam, moisture in air, ozone ($O_3$), etc., onto the surface of the photoconductive layer. Also, at the same time, the foregoing surface layer functions as a surface protective layer for preventing the characteristics of the photoconductive layer itself from being destroyed by the action of external factors such as the addition of stress, the attack of reactive chemical substances, etc.

Furthermore, the foregoing surface layer functions as a release inhibiting layer of atoms constituting the layer for constituting the layer atoms constituting the layer, such as hydrogen, etc., which are generally contained in the photoconductive layer mainly composed of amorphous silicon from releasing from the photoconductive layer.

For the electrophotographic photoreceptor, a so-called Carlson system of carrying out charging and an image-exposure is applied and for the purpose, it is necessary to reduce the insulating property of the surface layer for preventing the accumulation of charges on the surface or the inside of the surface layer. However, if an electric conductivity is too high, the transfer of charges occurs to the width direction to cause image blurring on the image formed. On the contrary, if the electric conductivity is too low, charges are accumulated to form fog on the images formed. Accordingly, the electric conductivity of the surface layer must be controlled to a suitable value, i.e., electric conductivity $\sigma$ of from $10^{12}$ to $10^{14}$ $\Omega^{-1}.cm^{-1}$ and the electric conductivity must be stable to external influences such as a temperature, humidity, etc. Furthermore, for use in the Carlson system, the surface layer of the photoreceptor must have a satisfactory mechanical strength. Also, the surface layer must be colored with a material being added to reduce the insulating property thereof to an extent of undesirable influences on the spectral sensitivity of the photoreceptor.

The surface layer is formed on the photoconductive layer or an interlayer which is formed, if necessary, on the photoconductive layer by coating thereon a coating composition having an electrically conductive fine powder dispersed in a binder resin or by forming a film of the foregoing coating composition and laminating the film thereon.

The electrically conductive fine powder being dispersed in the surface layer is preferably an electrically conductive metal oxide fine powder having an average particle size of not larger than 0.3 $\mu$m, and preferably in the range of from 0.05 $\mu$m to 0.3 $\mu$m.

As the electrically conductive metal oxide fine powder, the fine powder of, e.g., zinc oxide, titanium oxide, tin oxide, antimony oxide, indium oxide, bismuth oxide, tin oxide doped with tin, or zirconium oxide can be used. These metal oxide fine powders may be used singly or as a mixture thereof. In the case using as a mixture of these powders, they may be used as the fine powder of the solid solution or the fused product thereof.

As the organic polymer material being used as the binder resin for the surface layer in the present invention, an electrically active polymer material such as polyvinyl carbazole or an electrically inactive polymer material may be used. As the organic polymer materials which can be used in the present invention, there are polyvinyl carbazole, acrylic resins, polycarbonate resins, polyester resins, vinyl chloride resins, fluorine resins, polyurethane resins, epoxy resins, unsaturated polyester resins, polyamide resins, polyimide resins, etc. In these resins, a curing type resin is preferred in the points of the mechanical strength and adhesive property.

In the case of using the organic polymer material as the binder resin, the surface layer can be formed by controlling the viscosity of a coating composition obtained by dissolving or dispersing the organic polymer material in a solvent, coating the coating composition on the photosensitive layer or an interlayer formed on the photosensitive layer by a spray coating method or a dip coating method, and then drying or dry-curing.

In this case, for improving the dispersibility of the binder resin or the adhesive property or the smoothness of the surface layer, various additives may be added to the coating composition.

As the inorganic polymer material being used as the binder resin for the surface layer in the present invention, an inorganic polymer material formed from a silicone resin or an organic metal compound can be used. When the inorganic polymer material is, for example, a liquid silicone resin, the foregoing electrically conductive fine powder is dispersed therein and the dispersion may be coated and dried.

Also, the inorganic polymer material can be formed by a sol-gel method as follows.

That is, an alkoxide compound such as $Si(OCH_3)_4$, $Si(OC_2H_5)_4$, $Si(OC_3H_7)_4$, $Si(OC_4H_9)_4$, $Al(OCH_3)_3$, $Al(OC_2H_5)_3$, $Al(OC_4H_9)_3$, $Ti(OC_3H_7)_4$, $Zr(OC_3H_7)_4$, $Ti(OC_3H_7)_4$, $Y(OC_3H_7)_3$, $Y(OC_4H_9)_3$, $Fe(OC_2H_5)_3$, $Fe(OC_3H_7)_3$, $Fe(OC_4H_9)_3$, $Nb(OCH_3)_5$, $Nb(OC_2H_5)_5$, $Nb(OC_3H_7)_5$, $Ta(OC_3H_7)_5$, $Ta(OC_4H_9)_4$, $Ti(OC_3H_7)_4$, $V(OC_4H_5)_3$, $V(OC_4H_9)_3$, etc., or an organic metal complex such as iron.tris(acetyl acetonate), cobalt.bis(acetyl acetonate), nickel.bis(acetyl acetonate), copper.bis(acetyl acetonate), etc., is dissolved in an alcohol and is hydrolyzed with stirring. The foregoing electrically conductive fine powder is dispersed in the sol liquid formed by the reaction, the dispersion obtained was coated on the photoconductive layer or an interlayer formed on the photoconductive layer by a spray coating method or a dip coating method, and after removing the solvent, the coated layer may be dried by heating to a temperature of from 50° C. to 300° C. for 24 hours to 1 hour.

The thickness of the surface layer can be selected optionally but is preferably 20 $\mu$m or less, and particularly preferably from 0.1 $\mu$m to 10 $\mu$m. If the thickness of the surface layer is thicker than 20 $\mu$m, the residual potential after exposure is high, while if the thickness is less than 0.1 $\mu$m, the mechanical strength of the surface layer is deficient, thereby the feature of the amorphous silicon photoreceptor cannot be sufficiently utilized.

In the present invention, it is preferred that an interlayer is formed between the surface layer and the photoconductive layer. The interlayer functions as an adhesive layer as well as functions for reducing the influence of the surface oxidation in the surface layer and for preventing the injection of electrostatic charges from the surface layer.

As the interlayer, at least one layer composed of amorphous silicon carbide, amorphous silicon nitride, amorphous silicon oxide, or amorphous carbon each containing at least one of hydrogen and a halogen may exist. The interlayer is particularly preferably formed by a plasma CVD method since in this case, the interlayer is excellent in the points of adhesive property and the formability.

In the case of forming the foregoing amorphous silicon compound layer by a plasma CVD method, as a raw material for the amorphous silicon compound, silanes or higher order silanes, such as $SiH_4$, $Si_2H_6$, $SiCl_4$, $SiHCl_3$, $SiH_2Cl_2$, $Si(CH_3)_4$, $Si_3H_8$, $Si_4H_{10}$, etc., can be used.

As a raw material of carbon as the main component for amorphous silicon carbide or amorphous carbon being used as the interlayer in the present invention, there are aliphatic hydrocarbons such as paraffinic hydrocarbons shown by formula $C_nH_{2n+2}$, such as methane, ethane, propane, butane, pentane, etc., olefinic hydrocarbons shown by formula $C_nH_{2n}$, such as ethylene, propylene, butyrene, pentene, etc., and acetylenic hydrocarbons shown by formula $C_nH_{2n-2}$, such as acetylene, allylene, butyne, etc.; alicyclic hydrocarbons such as cyclopropane, cyclobutane, cyclopentane, cyclohexane, cycloheptane, cyclobutyne, cyclopentene, cyclohexene, etc.; and aromatic hydrocarbon compounds such as benzene, toluene, xylene, naphthalene, anthracene, etc.

Furthermore, the foregoing hydrocarbons may be halogen-substituted hydrocarbons such as carbon tetrachloride, chloroform, carbon tetrafluoride, trifluoromethane, chlorotrifluoromethane, dichlorofluoromethane, bromotrifluoromethane, fluoroethane, perfluoropropane, etc.

As a raw material of nitrogen for amorphous silicon nitride, there are nitrogen ($N_2$) and gaseous or gasifiable nitrogen compounds such as ammonia ($NH_3$), hydrazine ($H_2NNH_2$), hydrogen azide ($HN_3$), ammonium azide ($NH_4N_3$), etc.

As a starting material which can become a raw material gas for the introduction of an oxygen atom in amorphous silicon oxide, gases such as oxygen ($O_2$), ozone ($O_3$), carbon monoxide (CO), carbon dioxide ($CO_2$), nitrogen monoxide (NO), nitrogen dioxide ($NO_2$), nitrogen sesquioxide ($N_2O_3$), dinitrogen tetroxide ($N_2O_4$), dinitrogen pentoxide ($N_2O_5$), nitrogen trioxide ($NO_3$), tetramethoxysilane [$Si(OCH_3)_4$], tetraethoxysilane [$Si(OC_2O_5)_4$], etc., can be used.

The foregoing raw materials may be in a gaseous state, a solid state, or a liquid state at normal temperature when the raw material is in a solid state or a liquid state, the raw material is gasified at introducing it into a reaction chamber.

The intermediate layer may be a single layer or a laminated layer of layers each containing a different element. The distribution of an element in the interlayer may be uniform or nonuniform. In the case of a nonuniform distribution, there may be an intermittent change or a continuous change.

The condition for forming the interlayer by a plasma CVD method in the case of, e.g., alternative current discharging is as follows. The frequency is usually from 0.1 to 30 MHz, and preferably from 5 to 20 MHz, the degree of vacuum at discharging is from 0.1 to 5 Torrs (1.33 to 66.7 $N/m^2$), the substrate heating temperature is from 100° C. to 400° C, and the growth rate is from 0.01 to 3 μm/hr.

The thickness of the interlayer is from 0.05 μm to 10 μm and is preferably in the range of from 0.1 μm to 5 μm. If the thickness is less than 0.05 μm, the charge inhibiting property of the interlayer is inferior, while if the thickness is thicker than 5 μm, the residual potential becomes high and the sensitivity is lowered.

Then, the invention is described more practically by referring to the following examples and comparison examples.

EXAMPLE 1

A cylindrical aluminum substrate was disposed at a predetermined position in a capacitive coupling type plasma CVD apparatus and by glow discharge-decomposing a mixed gas of a silane ($SiH_4$) gas, a hydrogen ($H_2$) gas, and hydrogen-diluted diborane ($B_2H_6/H_2$)$^-$ gas in the reaction chamber, a charge blocking layer of 3 μm in thickness composed of amorphous silicon was formed on the cylindrical aluminum substrate. The conditions for forming the layer were as follows.

Charge Blocking Layer

- 100% Silane gas flow rate: 200 $cm^3$/min.
- 100 ppm Hydrogen-diluted diborane gas flow rate: 200 $cm^3$/min.
- Reaction vessel inside pressure: 1.0 Torr
- Discharging electric power: 200 watts
- Discharging frequency: 13.56 MHz
- Support temperature: 250° C.
- Growth rate: 3 μm/hr.

(In addition, in all the following examples and comparative examples, the discharging frequency and the support temperature in the formation conditions of each layer by a plasma CVD method were fixed to the foregoing values).

After forming the charge blocking layer, the reaction vessel was sufficiently exhausted and then by glow discharge-decomposing a mixed gas of a silane ($SiH_4$) gas, an ethylene gas, a hydrogen ($H_2$) gas, and a hydrogen-diluted diborane ($B_2H_6H_2$) gas in the reaction vessel, a charge transporting layer of 20 μm in thickness composed of amorphous silicon carbide was formed on the charge blocking layer formed on the cylindrical aluminum substrate. The conditions for forming the charge transporting layer were as follows.

Charge Transporting Layer

- 100% Silane gas flow rate: 180 $cm^3$/min.
- 100% Ethylene gas flow rate: 20 $cm^3$/min.
- 100% Hydrogen gas flow rate: 180 $cm^3$/min.
- 40 ppm Hydrogen-diluted diborane gas flow rate: 20 $cm^3$/min.
- Reaction vessel inside pressure: 1.0 Torr
- Discharging electric power: 300 watts
- Growth rate: 5 μm/hr.

After the formation of the charge transporting layer, the reaction vessel was sufficiently exhausted and then by glow discharge-decomposing a mixed gas of a silane ($SiH_4$) gas, a hydrogen ($H_2$) gas, and a hydrogen-diluted diborane ($B_2H_6H_2$) gas, a charge generating layer of 2 μm in thickness composed of amorphous silicon was formed on the charge transporting layer on the cylindrical aluminum substrate. The conditions for the formation of the layer were as follows.

Charge Generating Layer

- 100% Silane gas flow rate: 200 $cm^3$/min.
- 100% Hydrogen gas flow rate: 195 $cm^3$/min.
- 40 ppm Hydrogen-diluted diborane gas flow rate: 5 $cm^3$/min.
- Reaction vessel inside pressure: 1.0 Torr
- Discharging electric power: 300 watts
- Growth rate: 5 μm/hr.

After forming the charge generating layer, the reaction vessel was sufficiently exhausted and then by glow discharge-decomposing a mixed gas of a silane ($SiH_4$) gas, a hydrogen ($H_2$) gas, and an ammonia ($NH_3$) gas, a first interlayer of 0.3 μm in thickness composed of amorphous silicon nitride was formed on the charge generating layer on the cylindrical aluminum substrate. The conditions for forming the layer were as follows.

First Interlayer

100% Silane gas flow rate: 30 $cm^3$/min.
100% Hydrogen gas flow rate: 200 $cm^3$/min.
100% Ammonia gas flow rate: 30 $cm^3$/min.
Reaction vessel inside pressure: 0.5 Torr
Discharging electric power: 60 watts
Growth rate: 0.6 μm/hr.

After forming the first interlayer, the reaction vessel was sufficiently exhausted and then by glow discharge-decomposing a mixed gas of a silane ($SiH_4$) gas, a hydrogen ($H_2$) gas, and an ammonia ($NH_3$) gas, a second interlayer of 0.1 μm composed of amorphous silicon nitride was formed on the first interlayer on the cylindrical aluminum substrate. The conditions for forming the layer were as follows.

Second Interlayer

100% Silane gas flow rate: 17 $cm^3$/min.
100% Hydrogen gas flow rate: 200 $cm^3$/min.
100% Ammonia gas flow rate: 43 $cm^3$/min.
Reaction vessel inside pressure: 0.5 Torr
Discharging electric power: 60 watts
Growth rate: 0.5 μm/hr.

Then, a surface layer composed of an organic polymer material having dispersed therein an electrically conductive metal oxide fine powder having an average particle size of 0.3 μm or less was formed on the second interlayer.

In this case, the conditions for forming the second interlayer was as follows.

| | |
|---|---|
| Tin oxide/antimony oxide (15%) electrically conductive powder: | 14 parts by weight |
| Polyurethane resin (Retan Clear, trade name, made by Kansai Paint Co., Ltd.): | 55 parts by weight |

After dispersing the mixture of the aforesaid components using a ball mill for 50 hours, 7 parts by weight of Retan Hardening Agent (trade name, made by Kansai Paint Co., Ltd.) was added to the dispersion to provide a coating composition. The coating composition obtained was spray-coated on the second interlayer and dried at 120° C. for 2 hours to form the surface layer having a thickness of 3 μm.

By observing the cross-section of the surface layer, it was confirmed that particles having particle sizes of not larger than 0.1 μm were 70%, particles having particle sizes of from 0.1 μm to 0.3 μm were 25%, and particles having particle sizes of larger than 0.3 μm were 5%.

Using the electrophotographic photoreceptor thus prepared, the image evaluation was carried out with an electrophotographic copying apparatus, FX 5990 (trade name, made by Fuji Xerox Co., Ltd.). As the surrounding circumstance of disposing the copying apparatus, three kinds of 30° C. and 85% RH, 20° C. and 50% RH, and 10° C. and 15% RH were employed (hereinafter, the three kinds of the surrounding circumstances are called as the three circumstances).

The results showed that in the initial images and the images after printing 20,000 prints, no image blurring was observed.

Furthermore, under the surrounding circumstance of 30° C. and 85% RH, 300,000 copies were copied but neither image blurring nor fog was observed. Also, in the copied images formed without applying exposure, only two white points having a size of 0.2 mm or less were observed as image defects in the range corresponding to the whole surface of the photoreceptor.

When the electrophotographic characteristics of the electrophotographic photoreceptor were measured, the characteristics were same as those of the case in the following Comparative Example 1 except that the residual potential increased by 30 volts.

The electrophotographic photoreceptor was mounted on a semiconductor laser printer, XP-9 (trade name, made by Fuji Xerox Co., Ltd.) and printing was carried out, thereby images having a high quality without having moire were obtained.

Comparative Example 1

By following the same procedure as Example 1 described above except that the surface layer composed of the organic polymer compound having dispersed therein the electrically conductive metal oxide fine powder was not formed, that is, the first interlayer and the second interlayer were formed as the surface layer, an electrophotographic photoreceptor was prepared. In this case, the electrophotographic photoreceptor had on an aluminum support (substrate) a charge blocking layer, a charge transporting layer, a charge generating layer, and first and second surface layers each composed of amorphous silicon nitride.

Using the electrophotographic photoreceptor, the image evaluation was carried out by the same manner and conditions as in Example 1. The results showed that clear images were obtained under initial three circumstances.

Also, after the initial image evaluation, about 20,000 copies were printed under the surrounding circumstance of 20° C. and 15% RH and thereafter, the image evaluation was carried out while changing the surrounding circumstance of disposing the copying apparatus, whereby severe image blurring occurred under the circumstance of 30° C. and 85% RH.

Furthermore, when a drum heater was placed in the inside of the photoreceptor and 300,000 copies were printed under the circumstance of 20° C. and 50% RH while heating the photoreceptor to 45° C., neither image blurring nor fog was observed but in the copied images without applying exposure, one white point having a diameter of 0.5 mm, two white points having a diameter of 0.3 mm, and five white points having a diameter of not larger than 0.2 mm were observed in the range corresponding to the whole surface of the electrophotographic photoreceptor. These white points did not exist at the initial stage and formed by repeating the copying operation.

Also, white slight stripes were observed on one of paper releasing iron claws.

When the electrophotographic photoreceptor was mounted on a semiconductor laser printer, XP-9 (trade name, made by Fuji Xerox Co., Ltd.) and printing was carried out, moires were observed on the whole surface, which greatly reduced the quality of the image formed.

EXAMPLE 2

By following the same procedure as Example 1 except that a charge generating layer composed of amorphous silicon containing germanium was employed in place of the charge generating layer composed of amorphous silicon, an electrophotographic photoreceptor was prepared. That is, the charge blocking layer, the charge transporting layer, the first and second interlayers, and the surface layer were formed by the same manner and conditions as in Example 1. The conditions for forming the charge generating layer composed of germanium-containing amorphous silicon formed were as follows. In addition, the thickness of the charge generating layer was also 2 μm.

Charge Generating Layer (Germanium-Containing Amorphous Silicon Layer)

100% Silane gas flow rate: 175 $cm^3$/min.
50% Hydrogen-diluted germane gas flow rate: 50 $cm^3$/min.
100% Hydrogen gas flow rate: 170 $cm^3$/min.
40 ppm Hydrogen-diluted diborane flow rate: 5 $cm^3$/min.
Reaction vessel inside pressure: 1.0 Torr
Discharging electric power: 300 watts
Growth rate: 5 μm/hr.

When the electrophotographic characteristics of the electrophotographic photoreceptor prepared were measured, it was confirmed that the long wavelength sensitivity (800 nm) thereof was 1.2 times higher than that of the photoreceptor in Example 1.

About the electrophotographic photoreceptor, the image evaluation was carried out by the same manner and conditions as in Example 1. The results showed that in the initial images and images after printing 20,000 copies, no image blurring was observed under the three circumstances.

Also, when the electrophotographic photoreceptor was mounted on a semiconductor laser printer, XP-9 (trade name, made by Fuji Xerox Co., Ltd.) and printing was carried out, print samples having a good image density were obtained.

EXAMPLE 3

By the same manner and conditions as in Example 1, the charge blocking layer, the charge transporting layer, and the charge generating layer were formed. Then, in place of the first and second interlayers in Example 1, an interlayer of 0.2 μm in thickness and composed of amorphous silicon carbide was formed under the following conditions.

Interlayer

100% Silane gas flow rate: 40 $cm^3$/min.
100% Ethylene gas flow rate: 200 $cm^3$/min.
100% Hydrogen gas flow rate: 100 $cm^3$/min.
Reaction vessel inside pressure: 0.25 Torr
Discharging electric power: 200 watts
Growth rate: 1 μm/hr.

Then, a surface layer having the same composition as in Example 1 was formed on the interlayer thus formed at a thickness of 5 μm.

When the electrophotographic characteristics of the electrophotographic photoreceptor thus prepared were measured, the characteristics were same as those in Comparative Example 2 shown below except that the residual potential was increased to 50 volts.

About the electrophotographic photoreceptor, the image evaluation was carried out by the same manner and conditions as in Example 1. The results showed that in the initial images and images after printing 20,000 copies, no image blurring was observed under the three circumstances.

Comparative Example 2

By following the same procedure as Example 3 except that the surface layer composed of the organic polymer material having dispersed therein the electrically conductive metal oxide fine powder was not formed, that is, the interlayer was used as the surface layer, an electrophotographic photoreceptor was prepared. In this case, the electrophotographic photoreceptor had on an aluminum support the charge blocking layer, the charge transporting layer, the charge generating layer, and the surface layer composed of amorphous silicon.

When using the electrophotographic photoreceptor and the image evaluation was carried out by the same manner and conditions as in Example 1, clear images were obtained under the three circumstances at initial printing.

Also, after the initial image evaluation, when a printing test of about 20,000 prints was carried out under the circumstance of 20° C. and 15% RH and thereafter the image evaluation was carried out while changing the surrounding circumstance for disposing the copying apparatus, severe image blurring occurred under the circumstance of 30° C. and 85% RH. Also, white stripes which were considered to be caused by a cleaning blade occurred.

EXAMPLE 4

By following the same procedure as Example 1 except that the surface layer composed of an inorganic polymer material having dispersed therein an electrically conductive metal oxide fine powder having an average particle size of not larger than 0.3 μm was formed in place of the surface layer in Example 1, an electrophotographic photoreceptor was prepared.

The conditions for forming the surface layer were as follows.

| Surface Layer | |
|---|---|
| Tin oxide/antimony oxide (15%) electrical conductive powder: | 9 parts by weight |
| Silicon hard coating material for protective coating (X-41-9710H, trade name, made by Shin-Etsu Chemical Co., Ltd.): | 50 parts by weight |

The mixture of the above components was dispersed in a ball mill for 50 hours at 10° C., the dispersion was coated by a spray coating method and dried for one hour at 200° C. to form the surface layer having a thickness of 2 μm.

When the electrophotographic characteristics of the electrophotographic photoreceptor were measured, the characteristics were same as those in Comparative Example 1 except that the residual potential increased by 20 volts.

About the electrophotographic photoreceptor, the image evaluation was carried out by the same manner and condition as in Example 1. The results showed that in the initial images and images after the printing test of 20,000 copies, no image blurring was observed under the three circumstances. Also, after further copying 300,000 copies, no image blurring was observed. Also, as an image defect, only one white point having a diameter of not larger than 2 mm was observed. Furthermore, no abrasion by paper releasing iron claws was observed.

Comparative Example 3

By following the same procedure as in Example 2 described above except that the charge generating layer and the charge transporting layer were formed as one united photoconductive layer, an electrophotographic photoreceptor was prepared. In this case, the electrophotographic photoreceptor had on the aluminum support, the charge blocking layer, the photoconductive layer, the first and second interlayers, and the surface layer composed of the organic polymer material having dispersed therein the electrically conductive metal oxide fine powder.

The photoconductive layer composed of germanium-containing amorphous silicon was formed by the following conditions.

In addition, the thickness of the photoconductive layer was adjusted to 22 μm.

Photoconductive Layer

100% Silane gas flow rate: 185 $cm^3$/min.

50% Hydrogen-diluted germane gas flow rate: 30 $cm^3$/min.

100% Hydrogen gas flow rate: 182 $cm^3$/min.

40 ppm Hydrogen gas-diluted diborane gas flow rate: 3 $cm^3$/min.

Reaction vessel pressure: 1.0 Torr

Discharging electric power: 300 watts

When the electrophotographic characteristics of the electrophotographic photoreceptor prepared were measured, the characteristics of a long wavelength sensitivity (800 nm) showed the increase of the sensitivity of 1.2 times as compared to those in Examples 1 and 2. However, charging faculty was lowered to ¾ as compared with that in Example 2 to the same charge electric current.

When the image evaluation was carried out about the electrophotographic photoreceptor by the same manner and conditions as in Example 1, the image blurring, etc., was not observed but print samples only having a low density were obtained.

EXAMPLE 5

By following the same procedure as in Example 4 except that the forming conditions of the charge transporting layer and the first and second interlayers were changed as follows, an electrophotographic photoreceptor was prepared.

The conditions of the charge transporting layer were as follows and the thickness of the layer was adjusted to 18 μm.

Charge Transporting Layer

100% Silane gas flow rate: 170 $cm^3$/min.

100% $C_2F_6$ gas flow rate: 30 $cm^3$/min.

100% Hydrogen gas flow rate: 180 $cm^3$/min.

40 ppm Hydrogen gas-diluted diborane flow rate: 20 $cm^3$/min.

Reaction vessel pressure: 1.0 Torr

Discharging electric power: 300 watts

Also, in place of the first and second interlayers, the interlayer of 0.2 μm in thickness composed of amorphous carbon was formed under the following conditions.

Interlayer

100% $C_2F_6$ gas flow rate: 50 $cm^3$/min.

100% $C_2H_4$ gas flow rate: 150 $cm^3$/min.

Reaction vessel pressure: 0.5 Torr

Discharging electric power: 600 watts

When the electrophotographic characteristics of the electrophotographic receptor prepared were measured, the almost same characteristics as in Example 4 were obtained. Also, when the image evaluation was carried out by the same manner and conditions as in Example 1, after printing 20,000 copies, no image blurring was observed under the three circumstances.

In addition, about each of the electrophotographic photoreceptors obtained in Examples 1 to 5 and Comparative Examples 1 to 3, an interference amount was determined.

In the experiment, the electrophotographic photoreceptor obtained was set on a rotary shaft, semiconductor laser light of 780 nm was applied from the laser light source to the surface of the photoreceptor at an angle of 45°, and the reflected light from the photoreceptor was detected by a photocell at an angle of 45° at the opposite side. In addition, detecting light was amplified by an amplifier. The laser light and the photocell were scanned to the axis direction of the photoreceptor drum, and while rotating the photoreceptor drum, the reflected light of the while axis direction of the photoreceptor was measured. In this case, the maximum width of the fluctuation of the reflectance in the axis direction was defined as an interference amount.

The interference amounts obtained on the electrophotographic photoreceptors in the foregoing examples and comparative examples are shown below.

| | Example | | | | | Comparative Example | | |
|---|---|---|---|---|---|---|---|---|
| | 1 | 2 | 3 | 4 | 5 | 1 | 2 | 3 |
| Interference Amount (%) | 3% | 1% | 2% | 1.5% | 1.5% | 15% | 10% | 1% |

Since, experimentally, in the case that the interference amount is within 5%, the occurrence of the interference fringes on an image can be prevented, it was clear that the samples of the present invention had the effect of preventing the occurrence of the interference fringes.

As described above, since in the electrophotographic photoreceptor of the present invention, the surface layer is composed of an organic polymer material or an inorganic polymer material having dispersed therein an electrically conductive fine powder, the photoreceptor has the advantages that there is no image blurring by copying for a long period of time, the residual potential is low, the photoreceptor is excellent in an abrasion resistance and a durability, and the occurrences of white points, black points, white stripes, etc., by copying for a long period of time are less, different from conventional electrophotographic photoreceptors mainly composed of amorphous silicon having a layer mainly composed of amorphous silicon, amorphous silicon carbide, amorphous silicon nitride, amorphous silicon oxide, or amorphous carbon as the surface layer.

Also, the electrophotographic photoreceptor of the present invention can give images of high image quality using a coherent light such as an infrared semiconductor laser light, etc., without causing interference fringes by a laser printer.

While the invention has been described in detail and with reference to specific examples thereof, it will be apparent to one skilled in the art that various changes and modifications can be made therein without departing from the spirit and scope thereof.

What is claimed is:

1. An electrophotographic photoreceptor comprising an electrically conductive substrate having provided thereon at least a photoconductive layer and a surface protective layer as a release inhibiting layer, wherein said photoconductive layer comprises (a) a charge transporting layer mainly composed of amorphous silicon containing at least one of hydrogen and a halogen and at least one selected from carbon, oxygen and nitrogen and (b) a charge generating layer composed of amorphous silicon containing at least one of hydrogen and a halogen or amorphous silicon containing at least one of hydrogen and a halogen and at least one selected from germanium and tin, and said surface layer is composed of at least one of an organic polymer material and an inorganic polymer material having dispersed therein an electrically conductive fine powder having an average particle size of not larger than 0.3 μm and wherein electroconductivity of said surface layer is from $10^{12}$–$10^{14}\Omega^{-1}.cm^{-1}$.

2. The electrophotographic photoreceptor as claimed in claim 1, wherein said photoreceptor further comprises at least one layer mainly composed of amorphous silicon carbide, amorphous silicon nitride, amorphous silicon oxide, or amorphous carbon each containing at least one of hydrogen and a halogen between the surface layer and the photoconductive layer as an interlayer.

3. The electrophotographic photoreceptor as claimed in claim 1, wherein said charge generating layer contains an element belonging to group III or group V of the periodic Table.

4. The electrophotographic photoreceptor as claimed in claim 1, wherein said charge transporting layer contains an element belonging to group III or group V of the periodic Table.

5. The electrophotographic photoreceptor as claimed in claim 1, wherein said photoreceptor further comprises a charge blocking layer between the photoconductive layer and the electrically conductive substrate.

6. The electrophotographic photoreceptor as claimed in claim 1, wherein said electrically conductive fine powder is a metal oxide fine powder.

7. The electrophotographic photoreceptor as claimed in claim 6, wherein said electrically conductive fine powder is a mixture of metal oxide fine powders.

8. The electrophotographic photoreceptor as claimed in claim 6, wherein said electrically conductive fine powder is a fine powder of zinc oxide, titanium oxide, tin oxide, antimony oxide, indium oxide, bismuth oxide, tin oxide doped with tin or zirconium oxide.

9. The electrophotographic photoreceptor as claimed in claim 1, wherein said electrically conductive fine powder has an average particle size of from 0.05 μm to 0.3 μm.

* * * * *